US010906684B2

(12) United States Patent
Hermans et al.

(10) Patent No.: US 10,906,684 B2
(45) Date of Patent: Feb. 2, 2021

(54) PACKAGING

(71) Applicant: TECHNOPAK LIMITED, Auckland (NZ)

(72) Inventors: Henricus Jacobus Johannes Hermans, Auckalnd (NZ); Shane Robert Reckin, Auckland (NZ)

(73) Assignee: TECHNOPAK LIMITED, Auckland (NZ)

( * ) Notice: Subject to any disclaimer, the term of this patent is extended or adjusted under 35 U.S.C. 154(b) by 313 days.

(21) Appl. No.: 15/559,271

(22) PCT Filed: Mar. 18, 2016

(86) PCT No.: PCT/NZ2016/050043
§ 371 (c)(1),
(2) Date: Sep. 18, 2017

(87) PCT Pub. No.: WO2016/148587
PCT Pub. Date: Sep. 22, 2016

(65) Prior Publication Data

US 2019/0009942 A1 Jan. 10, 2019

(30) Foreign Application Priority Data

Mar. 18, 2015 (NZ) ..... 706131

(51) Int. Cl.
*B65B 61/26* (2006.01)
*B65B 57/18* (2006.01)
(Continued)

(52) U.S. Cl.
CPC ..... *B65B 61/26* (2013.01); *B07C 5/3412* (2013.01); *B65B 1/18* (2013.01); *B65B 57/00* (2013.01);
(Continued)

(58) Field of Classification Search
CPC ..... B65B 61/025; B65B 61/26; B65B 61/20; B65B 1/18; B65B 57/11; B65B 57/18;
(Continued)

(56) References Cited

U.S. PATENT DOCUMENTS 6,312,742 B1 * 11/2001 Wood ..... B65D 31/02 426/122
8,555,605 B2 * 10/2013 Schmitz ..... G06Q 10/08 53/507
(Continued)

FOREIGN PATENT DOCUMENTS

WO WO2012/023862 2/2012

OTHER PUBLICATIONS

International Search Report, PCT/NZ2016/050043, dated May 20, 2016.
Written Opinion, PCT/NZ2016/050043, dated May 20, 2016.

*Primary Examiner* — Anna K Kinsaul
*Assistant Examiner* — Veronica Martin
(74) *Attorney, Agent, or Firm* — Nixon & Vanderhye

(57) ABSTRACT

Disclosed is a system for, or method of, packaging a product within a packaging bag, wherein the packaging bag includes an inner liner and an outer liner. The method including the steps of marking the inner liner with a first marking unit, filling the bag with the product, and subsequently marking the outer liner with a second marking unit. The markings may be machine readable and/or randomly generated and stored in a database. The system may further include a machine reader, which is capable of accessing the database, and which is capable of reading the markings on the inner liner and/or the outer liner, to thus determine if an outer liner subsequently removed from an inner liner is/was the same outer liner associated with the same inner liner, at the time when the bag was filled and/or packaged.

18 Claims, 4 Drawing Sheets

Figures 1, 2, 3:
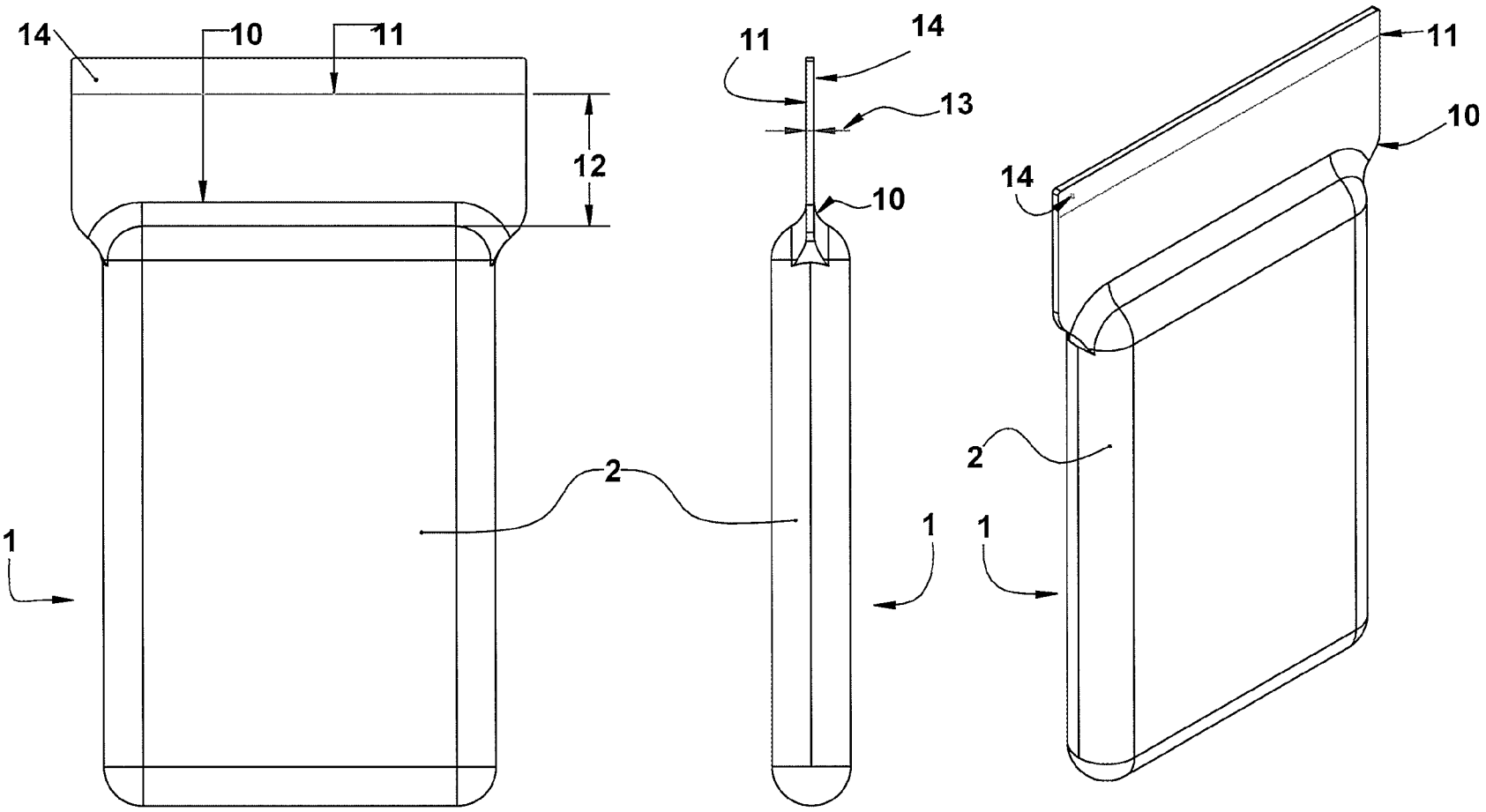

(51) Int. Cl.

| | |
|---|---|
| ***B65B 61/02*** | (2006.01) |
| ***B65B 57/00*** | (2006.01) |
| ***B65B 1/18*** | (2006.01) |
| ***B65D 75/30*** | (2006.01) |
| ***B07C 5/34*** | (2006.01) |
| *B65B 25/02* | (2006.01) |
| *B65B 51/10* | (2006.01) |
| *B65B 69/00* | (2006.01) |

(52) U.S. Cl.
CPC ..... *B65B 57/18* (2013.01); *B65B 61/025* (2013.01); *B65D 75/30* (2013.01); *B65B 25/02* (2013.01); *B65B 51/10* (2013.01); *B65B 69/0008* (2013.01); *B65B 2220/20* (2013.01); *B65D 2203/06* (2013.01)

(58) Field of Classification Search
CPC ..... B65B 25/02; B65B 51/10; B65B 69/0008; B65B 2220/20; B07C 5/3412; B65D 75/30; B65D 2203/06
USPC ..... 53/411, 131.2, 469, 284.7, 449, 171
See application file for complete search history.

(56) References Cited

U.S. PATENT DOCUMENTS

2005/0279236 A1 12/2005 Jennings
2007/0127855 A1* 6/2007 Smith ..... B65D 31/04 383/111
2012/0297731 A1* 11/2012 Sandor ..... B41J 3/4073 53/411
2014/0284380 A1* 9/2014 Toedtli ..... B65B 57/00 235/375
2015/0272824 A1* 10/2015 Jaynes ..... B65B 61/00 206/534
2015/0353214 A1* 12/2015 Gerstner ..... B65B 61/025 53/411

* cited by examiner

PACKAGING

FIELD

This invention relates to improvements in packaging.

More specifically, the invention relates to improvements in methods and apparatus for marking packaging bags, which include an inner liner (or packaging component) and an outer liner (or packaging component), and for convenience only therefore the invention will be predominantly described in relation to such use.

However, it is to be understood and appreciated that the invention may also have other applications and uses. The prior art and possible applications of the invention, as discussed below, are therefore given by way of example only.

BACKGROUND

Powdered or particulate food products such as flour and milk powder are usually bulk-packaged within large 25 kg bags. Such packaging bags usually consist of an outer liner in the form of one or more plies of a paper material, and an inner liner in the form of a sealable plastics material. Such packaging bags are well known, and are currently used, within the bulk food packaging industry, and especially for the bulk packaging of milk powder. Several examples may be referenced in NZ Patent Nos. 183617 and 242034.

The outer paper liner/bag generally serves as a sanitary and/or hygienic cover for the inner plastic liner/bag, within which is housed the product. Hence, one function of the outer paper bag is to protect the inner plastic bag from contact with undesirables, for example during storage or transit. Undesirables may include dirt, dust, insects, grease, vermin, and so on.

Such packaging bags are usually manufactured at a bag making plant with the inner plastic liner/bag being formed, and subsequently fitted within each outer paper liner/bag, prior to the packaging bags being shipped to the end user, for example to a manufacturing and packaging plant such as a dairy factory. That is, the completed packaging bags leave the bag making plant, and arrive at the packaging plant, with the inner plastic liner/bag already fitted within the outer paper liner/bag. The inner plastic liner is usually lightly retained within each outer paper bag by the use of spot adhesives.

In an alternative arrangement, the inner plastic liner/bag and outer paper liner/bag may be shipped to a manufacturing and packaging plant separately, whereby workers (or automated machinery) fit each inner plastic liner into each outer paper outer bag prior to the completed packaging bags being packaged with product.

At the packaging plant, the bags are filled, and then sealed and closed. The filling and sealing of such bags at packaging plants will be well known to those skilled in the art. For example, suitable packaging machinery for filling and sealing 25 kg packaging bags with milk powder is manufactured and marketed by Technopak Ltd, of Auckland, New Zealand.

After the bags have been sealed, an inkjet printer is usually used to mark the outer paper bag. The markings may include any information, as required by either the packaging plant or the end user of the packaged product. For example, the markings may include the date, the factory, the type of powder within the bag, the batch number, the bag number, the "best before" date, a unique identifier for authenticity purposes, the name of the end user, and so on. Furthermore, the inkjet printer may also mark the bag with electronically-readable markings such as a barcode or QR code.

A disadvantage associated with the use of an inkjet printer for marking bags is that inkjet printers frequently require the ink cartridge to be replaced, and the replacement of the ink cartridge means that the packaging line must be stopped for a short period of time while the ink cartridge is replaced. Such stoppages ultimately affect the productivity of the packaging line. Moreover, there is a cost associated with the frequent replacement of ink cartridges, namely the ink cartridges themselves.

Furthermore, inkjet printers can be messy, and if they malfunction (which they do occasionally), or if the bag is not properly lined up with the inkjet printer, ink may squirt all over the place—which not only creates a mess, but which presents a health hazard if the product being packaged is a food product. Such occurrences may also create a health hazard for the packing room workers, for example if they were to be to covered in ink but especially if they were to get ink in their eyes.

Moreover, inkjet printers spray wet ink onto the bag, and if the bag is inadvertently touched immediately afterwards by a person or by machinery, it may smudge the marking, which may render it illegible, or unable to be machine-read (if, for example, the markings included a barcode reader or QR code reader). Such occurrences therefore render the marking process (which is of considerable importance) ineffective, which is clearly unsatisfactory.

Another problem or drawback associated with standard bag marking technologies, whether it be an inkjet printer or other means, is that only the outer paper liner/bag is marked, and not the inner plastic liner/bag. Hence, whilst the information provided by the marking may be visible and readable on the outer paper bag, once the outer paper bag has been removed from around the inner plastic bag, and discarded, the same relevant information cannot be gained from the inner plastic bag. This is not only frustrating, but it can also lead to confusion as to the identity of the product within the inner plastic bag and/or errors in the subsequent use or further packaging of the product within the inner plastic bag.

For example, a small milk powder packaging factory (which, say, packages milk powder into 1 kg tins) may receive bulk-packaged milk powder in the form of 25 kg bags from a dairy factory for repackaging into the 1 kg tins. The 25 kg bags of milk powder arrive at the factory and are usually taken to a holding area, where they sit until they are required. When a batch of 1 kg tins are to be made, a worker usually rips off the outer paper liners/bags (after checking that the markings on the paper bag are correct for the 1 kg product to be packaged), and the worker subsequently cuts the inner plastic liners/bags before tipping the milk powder into a hopper or bin, from where the product may be transported to be repackaged into 1 kg tins.

A problem arises if there are a backlog of unopened plastic inner bags (that is, bags with the outer paper liner/bag removed) waiting to be cut and tipped into a hopper (or feeding chute). This can occur when the 1 kg tin packaging line is down (for any reason), during which time the workers may nonetheless continue with the removal of the outer paper bags and stack the resultant backlog of unopened inner plastic bags.

Firstly, because there are no markings on the unopened backlog of plastic bags, none of the information which was available on the outer paper bags will be visible or readable.

Moreover, if different 25 kg bags arrive at different times, with different powders within them (for example, whey protein or casein or skim milk powder) there is no way of determining which plastic bag contains which type of powder (because the outer paper bags have been removed), and this may result in confusion. At best, the time taken to properly identify the powders within each plastic bag may result in lost production time. At worst, the wrong type of powder may be inadvertently packaged into the wrong type of 1 kg tin.

Another important consideration to take into account when packaging, storing and/or transporting products, such as food or pharmaceutical products, is ensuring that the product is genuine and/or has come from where it says it has come from. Such security and/or authenticity means may also serve to protect against counterfeit products, which may be of particular importance in relation to food and pharmaceutical products. Ensuring against counterfeit products is of particular importance to the end user of the product.

As a result, product security technologies for use with packaging have emerged, most notably devices such as holograms or Optically Variable Devices (OVD's). OVD's are usually attached to packaging materials by the use of adhesives, for example by hot foil stamping or by the use of pre-applied adhesives stuck to a carrier film.

Examples of the use (or manufacture) of OVD's for packaging may be found in the following patent documents: U.S. Pat. Nos. 5,913,543, 6,975,765, 7,095,324 and 4,758,296.

However, a disadvantage associated with the use of OVD's is that they may be susceptible to being removed from the packaging material, for example by the use of solvents to weaken the adhesives. In such instances, they may then be reapplied to a counterfeit or tampered product.

Alternatively, heat-sealed OVD's may be cut from the packaging material and removed, before being reapplied to a counterfeit or tampered product.

Another disadvantage associated with the use of OVD's is that they may be prohibitively expensive, either in themselves, or by virtue of the specialised machinery required to apply and/or read OVD's.

OBJECT

It is an object of the present invention to provide packaging methods and apparatus which goes some way towards addressing the aforementioned problems or difficulties, or which at the very least provides the public with a useful choice.

DEFINITIONS

Throughout this specification unless the text requires otherwise, the word 'comprise' and variations such as 'comprising' or 'comprises' will be understood to imply the inclusion of a stated integer or step or group of integers or steps but not the exclusion of any other integer or step or group of integers or steps.

Throughout this specification hereinafter, unless the text requires otherwise, the term "inner liner" is to be understood to refer to any type of inner packaging component associated with a packaging bag, and the term "outer liner" is to be understood to refer to any type of outer packaging component associated with a packaging bag.

STATEMENTS OF INVENTION

According to another aspect of the present invention, there is provided a method of packaging a product within a packaging bag, said packaging bag including an inner liner and an outer liner, said method including the steps of:

a) marking the inner liner with a first marking means, b) filling the bag with the product, c) marking the outer liner with a second marking means.

According to an alternative aspect of the present invention, there is provided a method of packaging a product within a packaging bag, said packaging bag including an inner liner and an outer liner, said method including the steps of:

a) filling the bag with the product, b) marking the inner liner with a first marking means, c) marking the outer liner with a second marking means.

According to another aspect of the present invention, there is provided a method of packaging a product within a packaging bag, substantially as described above, wherein the marking on the inner liner is substantially the same as, or identical to, the marking on the outer liner.

According to another aspect of the present invention, there is provided a method of packaging a product within a packaging bag, substantially as described above, wherein the marking on the inner liner is different to the marking on the outer liner.

According to another aspect of the present invention, there is provided a method of packaging a product within a packaging bag, substantially as described above, wherein the differences between the marking on the inner liner and the marking on the outer liner are such that a person would be unable to match the inner liner with the outer liner, when viewing the markings on the inner and outer liners, after they have been separated.

According to another aspect of the present invention, there is provided a method of packaging a product within a packaging bag, substantially as described above, wherein the marking made on the inner liner by the first marking means is a machine readable marking.

According to another aspect of the present invention, there is provided a method of packaging a product within a packaging bag, substantially as described above, wherein the marking made on the outer liner by the second marking means is a machine readable marking.

According to another aspect of the present invention, there is provided a method of packaging a product within a packaging bag, substantially as described above, wherein the nature of the markings made on the inner liner and the outer liner, by the first marking means and the second marking means respectively, are stored in a database at the time of application.

According to another aspect of the present invention, there is provided a method of packaging a product within a packaging bag, substantially as described above, wherein the nature of the markings made on the inner liner and the outer liner are transferred to the database, by the first and second marking means, either directly or indirectly, by the use of wireless communication technologies.

According to another aspect of the present invention, there is provided a method of packaging a product within a packaging bag, substantially as described above, wherein the arrangement and construction is such that a machine reader, which is capable of accessing the database, either directly or indirectly, and which is capable of reading the markings on the inner liner and/or the outer liner, is able to facilitate a determination as to whether an outer liner subsequently removed from an inner liner is/was the same outer liner associated with the same inner liner, at the time when the bag was filled and/or packaged.

According to another aspect of the present invention, there is provided a method of packaging a product within a packaging bag, substantially as described above, wherein the machine reader is adapted to be in communication with the database, either directly or indirectly, by the use of wireless communication technologies.

According to another aspect of the present invention, there is provided a method of packaging a product within a packaging bag, substantially as described above, wherein the machine reader is in two-way communication with the database, whereby the database is able to send an alert to the machine reader and/or a third party, if an outer liner removed from an inner liner is/was not the same outer liner associated with the same inner liner, at the time when the bag was filled and/or packaged.

According to another aspect of the present invention, there is provided a method of packaging a product within a packaging bag, substantially as described above, wherein the marking on the inner liner and/or the marking on the outer liner includes a barcode and/or a QR code.

According to another aspect of the present invention, there is provided a method of packaging a product within a packaging bag, substantially as described above, wherein the first marking means and/or the second marking means is/are laser etching machines.

According to another aspect of the present invention, there is provided a method of packaging a product within a packaging bag, substantially as described above, wherein the first marking means and the second marking means are separate machines.

According to another aspect of the present invention, there is provided a method of packaging a product within a packaging bag, substantially as described above, wherein the first marking means and the second marking means are the same machine.

According to another aspect of the present invention, there is provided a method of packaging a product within a packaging bag, substantially as described above, wherein the inner liner is made of a plastics material.

According to another aspect of the present invention, there is provided a method of packaging a product within a packaging bag, substantially as described above, wherein the outer liner is made of a paper material.

The inner liner may be made of any material considered suitable for the packaging of the product to be packaged, and the outer liner may also be made of any material considered suitable for the packaging of the product to be packaged. Examples of suitable materials may include, but not be limited to, plastic, paper, cardboard, tin foil, aluminium foil, as well as any combinations of these materials.

The inner and outer liners may include, or be comprised of, the same material as each other. For example, the inner liner may include a plastics material and the outer liner may include a plastics material.

Alternatively, the inner and outer liners may include, or be comprised of, a different material(s) to each other. For example, the inner liner may include an aluminium foil, and the outer liner may include a plastics material.

Alternatively, and for example, the inner liner may include a plastics material and the outer liner may include a paper material.

The inner liner may be comprised of a transparent, translucent or opaque material, or any combination of these materials.

The outer liner may be comprised of a transparent, translucent or opaque material, or any combination of these materials.

Preferably, the outer liner may be comprised of a substantially, or wholly, opaque material.

The packaging bag may be any type of packaging bag, that may be suitable for packaging any type of product.

Preferably, the packaging bag may be a 25 kg bag used for packaging milk powder.

In one embodiment, the method of packaging a product within the packaging bag may include the steps of marking the inner liner with a first marking means, filling the bag with the product, and marking the outer liner with a second marking means.

In such an embodiment, the method may include the further step of sealing the bag. The sealing step may occur either after the filling step or after the outer liner has been marked with the second marking means.

In one embodiment, the inner liner may be marked by the first marking means at the bag manufacturing plant either while it is being formed or after it has been formed.

Alternatively, the inner liner may be marked by the first marking means in the factory where the product is to be packaged. In such an embodiment, the inner liner may be marked with the first marking means prior to being placed within the outer liner or after having been placed within the outer liner.

In another embodiment, the method of packaging a product within the packaging bag may include the steps of filling the bag with the product, marking the inner liner with a first marking means, and marking the outer liner with a second marking means.

In such an embodiment, the method may also include the further step of sealing the bag. The sealing step may occur either after the inner liner has been marked with the first marking means or after the outer liner has been marked with the second marking means.

Examples of suitable packaging machinery for filling and sealing packaging bags (preferably with milk powder) are those manufactured and marketed by Technopak Ltd, of Auckland, New Zealand.

Examples of suitable markings include letters, numbers, words, symbols, pictures, logos and any combination of such markings.

In one embodiment, the marking on the inner liner may be substantially the same as, or identical to, the marking on the outer liner.

In an alternative embodiment, the marking on the inner liner may be different to the marking on the outer liner.

In such an embodiment, the differences between the marking on the inner liner and the marking on the outer liner may be such that a person would be unable to match the inner liner with the outer liner, when viewing the markings on the inner and outer liners, after they have been separated.

For example, the marking on the inner liner may be MATAX28395 and the marking on the outer liner may be SFJMH26618. There may however be a written record on paper or an electronic record in a database that lists each marking on each inner liner and matches it with its corresponding marking on the outer liner, taken from the time that the markings were made on the inner and outer liners, by the first and second marking means respectively.

Such a record may be used to determine whether an outer liner subsequently removed from an inner liner is/was the same outer liner associated with the same inner liner, at the time when the bag was filled and/or packaged.

In another embodiment, the marking made on the inner liner by the first marking means and/or the marking made on the outer liner by the second marking means may be a machine readable marking.

Preferably, both the marking made on the inner liner by the first marking means and the marking made on the outer liner by the second marking means may be machine readable markings.

Furthermore, the marking made on the inner liner by the first marking means and the marking made on the outer liner by the second marking means may be the same type of machine readable markings or alternatively they may be different machine readable markings.

Examples of suitable machine readable markings include, but are not limited to, barcodes and/or QR codes.

Preferably, the nature of the markings made on the inner liner and the outer liner, by the first marking means and the second marking means respectively, may be stored in a database at the time of application.

Preferably, the nature of the markings made on the inner liner and the outer liner may be transferred to the database, by the first and second marking means, either directly or indirectly, by the use of wireless communication technologies.

The first and/or second marking means may be in one-way communication with the database or in two-way communication.

Any suitable wireless technology known in the art may be used, including Wi-Fi (IEEE 802.11), LE Bluetooth®, Bluetooth®, other radio frequencies, Infra-Red (IR), GSM, CDMA, GPRS, 3G, 4G, W-CDMA, EDGE or DCDMA200 and similar technologies.

Alternatively, any suitable wired connections or ports may also be used, including, without limitation, USB ports or any other relevant or appropriate technology known in the art.

Preferably, and for example, the first and second marking means may wirelessly transmit the nature of the markings directly to an adjacent database, Preferably, the database may comprise a computing device or other electronic device. Examples include, without limitation, a mobile phone, a smartphone, an iPhone, an iPad, a tablet, a palmtop computer, a band or other wearable technology device, a small portable device, a laptop, a desktop computer, a cloud computing system, a remote network computer system (a public network, e.g. a website, or alternatively a private network) or to a web service.

Alternatively, the first and second marking means may first wirelessly transmit the nature of the markings to an intermediary computing or electronic device, such as those mentioned above, prior to the intermediary device subsequently transmitting the data or information to the database. Other examples of an intermediary device may include a router or transmitter or Bluetooth device.

Preferably, the method may also include the use of a machine reader, which is capable of accessing the database, and which is capable of reading the markings on the inner liner and/or the outer liner, and is able to facilitate a determination as to whether an outer liner subsequently removed from an inner liner is/was the same outer liner associated with the same inner liner, at the time when the bag was filled and/or packaged.

In such an embodiment, the machine reader may be adapted, or able, to be in communication with the database, either directly or indirectly, by the use of wireless communication technologies, such as those aforementioned.

The machine reader may be in one-way communication with the database or in two-way communication.

Preferably, the machine reader may be in two-way communication with the database, whereby the database is able to send an alert to the machine reader and/or a third party, if an outer liner removed from an inner liner is/was not the same outer liner associated with the same inner liner, at the time when the bag was filled and/or packaged.

The third party may be a separate computing or other electronic device belonging to a factory manager or to a floor manager or foreman or the person overseeing the operation involving the separation of the outer liners from the inner liners, and the subsequent emptying of the bags, for example into a hopper.

The alert may also, or alternatively, trigger an audio and/or visual alarm in the vicinity of the area where the outer liners are removed from the inner liners. Hence, and for example, the operation of removing the outer liners from the inner liners may be halted whilst the anomaly of why a removed outer liner did not match its inner liner—possibly implying that the product may be counterfeit or has otherwise been tampered with.

Preferably, the first and/or second marking means may be laser etching machines.

Alternatively, the first and/or second marking means may be ink jet printers, although these printers may have some or all of the drawbacks referred to previously, and so laser etching machines may be preferred.

In one embodiment, the first marking means and the second marking means may be different machines.

In an alternative embodiment, the first marking means and the second marking means may be the same machine.

According to another aspect of the present invention, there is provided a system for packaging a product within a packaging bag, said packaging bag including an inner liner and an outer liner, said system including:

a) apparatus for marking the inner liner with a first marking means,
b) apparatus for filling the bag with the product,
c) apparatus for marking the outer liner with a second marking means.

According to another aspect of the present invention, there is provided a system for packaging a product within a packaging bag, said packaging bag including an inner liner and an outer liner, said system including:

a) apparatus for filling the bag with the product,
b) apparatus for marking the inner liner with a first marking means,
c) apparatus for marking the outer liner with a second marking means.

According to another aspect of the present invention, there is provided a system for packaging a product within a packaging bag, substantially as described above, wherein said system further including some, or all, of the features, substantially as described above in relation to the method of packaging a product within a packaging bag.

PREFERRED EMBODIMENTS

The description of a preferred form of the invention to be provided herein, with reference to the accompanying drawing, is given purely by way of example and is not to be taken in any way as limiting the scope or extent of the invention.

DRAWING

Figure 4:
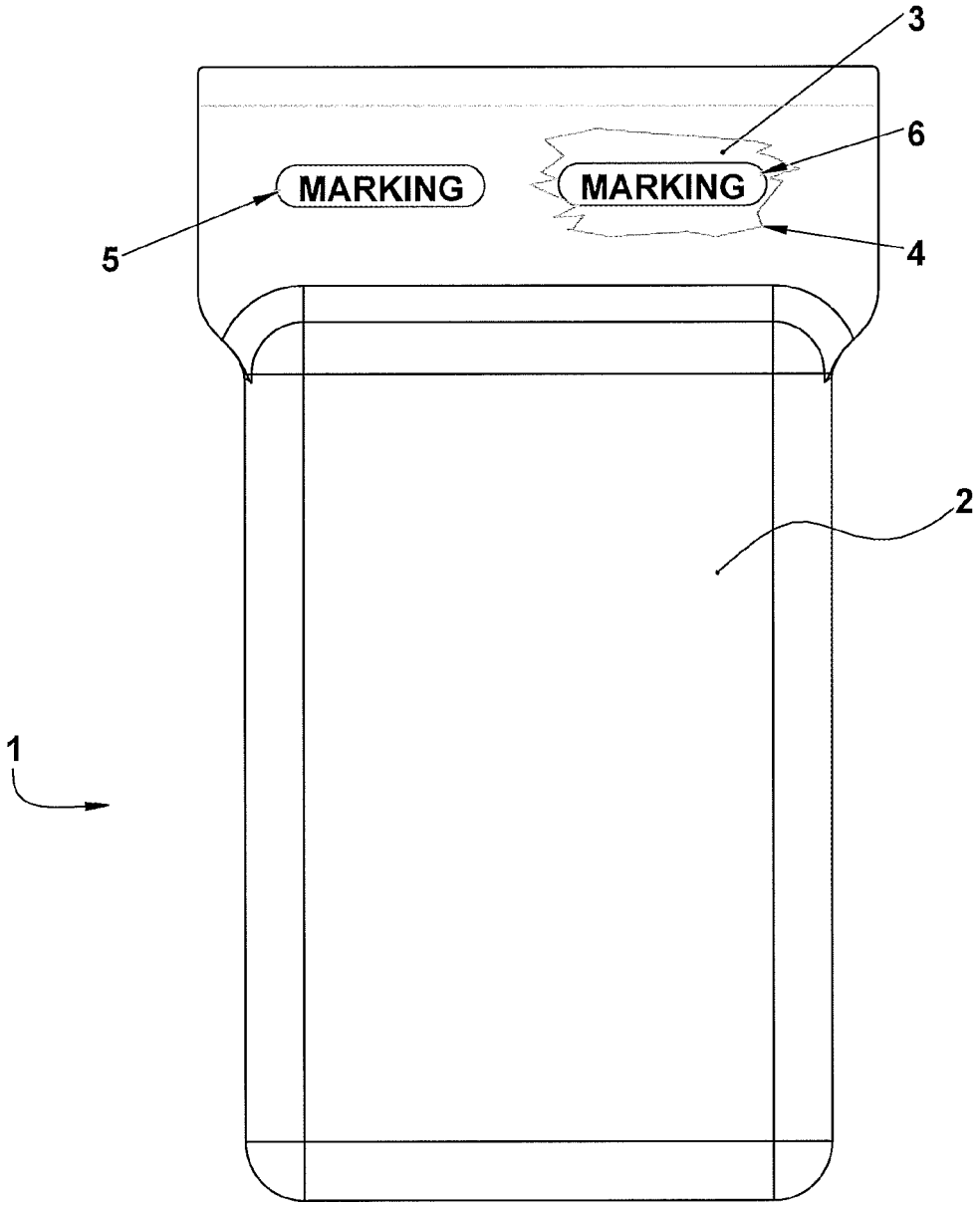
Figure 5:
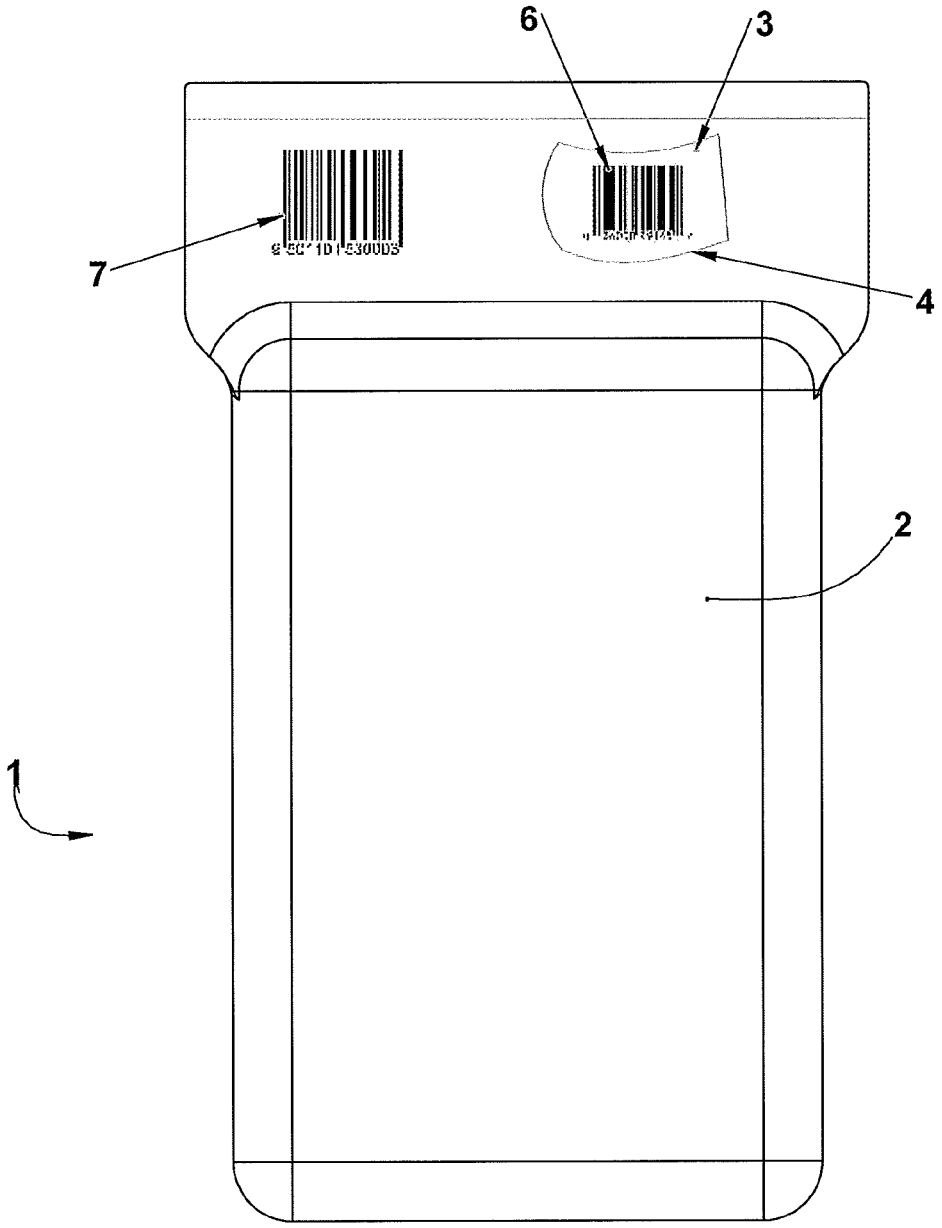
Figure 6:
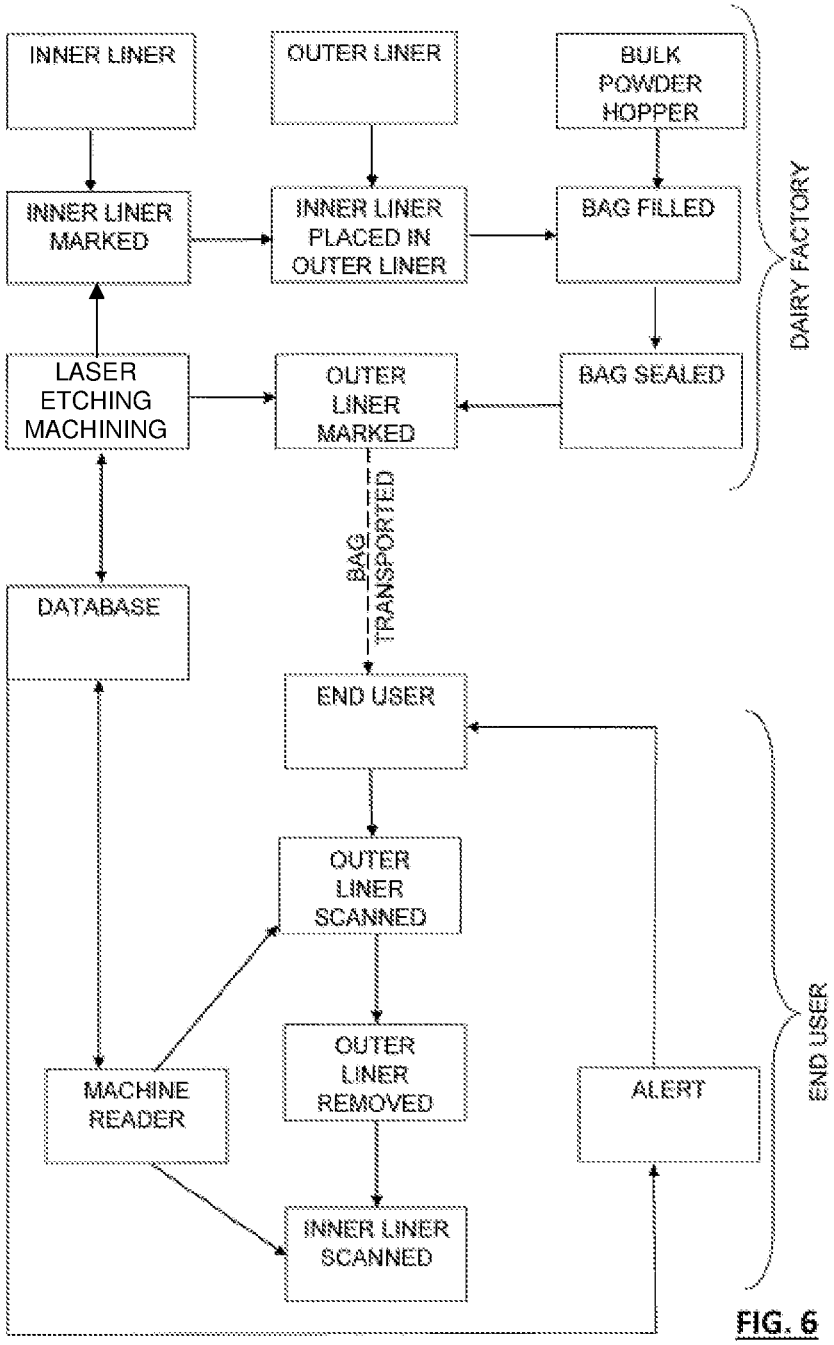

FIG. 1: is a front view of a 25 kg packaging bag, used for packaging milk powder, FIG. 2: is a side view of the packaging bag illustrated in FIG. 1, FIG. 3: is a perspective view of the packaging bag illustrated in FIGS. 1-2, FIG. 4: is a front view of the packaging bag of FIGS. 1-3, incorporating one aspect of the present invention, FIG. 5: is a front view of the packaging bag of FIGS. 1-3, incorporating another aspect of the present invention, and FIG. 6: is a schematic view showing one embodiment of the packaging system, and associated apparatus and methodology.

DESCRIPTION OF PREFERRED EMBODIMENTS

Having regard to FIGS. 1-3, there is shown a 25 kg bag used for the packaging of milk powder (not shown), the bag being generally indicated by arrow 1.

The bag 1 is of a form which has an outer liner 2 comprised of two or three ply paper material, and an inner liner 3 (see FIGS. 4 and 5) comprised of laminated plastic. In FIGS. 4 and 5, the inner liner 3 is shown in the cutaway section 4 of the outer liner 2.

The inner liner 3 is designed to be filled with 25 kg of milk powder, and the outer liner 2 is designed to provide a cover for the inner liner 3 during packaging and/or storage and/or transportation.

The outer liner 2 generally serves as a sanitary and/or hygienic cover for the inner liner 3, within which is housed the milk powder.

The top level of the milk powder within the bag 1 is indicated by arrow 10.

The top of the inner liner 3 within the outer liner 2 is indicated by arrow 11, thus leaving a small top strip of just the outer liner 14, which is not covering or enclosing any part of the inner liner 3.

The distance 12 between the top of the level of milk powder 10 and the top of the inner liner 11 is approximately 200-220 mm.

The bag 1 is heat sealed during the packaging process in the region indicated by arrow 13 (FIG. 2).

In the embodiment illustrated in FIGS. 1-3, the bag 1 is also vacuum sealed during the packaging process.

Examples, of packaging plants capable of packaging milk powder into the 25 kg bags 1, such as illustrated in FIGS. 1-3, are those manufactured and marketed by Technopak Ltd of Auckland New Zealand.

Having regard to FIG. 4, there is illustrated the packaged bag 1 of FIG. 1, wherein the inner liner 3 has been marked with a marking 6, and the outer liner 2 has been marked with a marking 5.

The markings 5,6 have both been formed by laser etching machines (not shown).

The markings 5,6 may be identical. Alternatively, the markings 5,6 may be different. In yet another embodiment, the markings 5,6 may contain some identical features and some different features.

The markings 5,6 may include material that is readable by a person.

For example, the markings 5,6 may include, but not be limited to, the date, the factory, the type of powder within the bag, the batch number, the bag number, the "best before" date, a unique identifier for authenticity purposes, the name of the end user, and so on.

Preferably, the inner liner 3 may be marked via laser etching prior to the inner liner 3 being filled.

For example, the inner liner 3 may be marked at the place where the inner liner 3 is made, that is, prior to being shipped to the milk packaging plant (for example a dairy factory).

Alternatively, the inner liner 3 may be marked at the milk packaging plant after the bags 1 have been delivered, but prior to the bags 1 being filled. This could be done at a separate laser etching station contained within the overall packaging plant.

The inner liner 3 may be marked before or after it has been placed within the outer liner 2.

In an alternative embodiment, the inner liner 3 could be marked after the bag 1 has been filled, but before the outer liner is marked.

In one embodiment, the markings 5,6 may be identical. In such an embodiment it may be appreciated that the contents or properties of the bag 1 (or information relating to the contents or properties of the bag 1) may be apparent and/or readable (by a person or a machine) even when the outer liner 2 has been removed and/or discarded. That is, the same information marked on the outer liner 2, relating to the contents or properties of the bag 1, may also be read from the inner liner 3, as provided for by the markings 5,6.

An advantage of such an arrangement, and for example, would be in the situation where a small milk powder packaging factory (which, for example, packages milk powder into 1 kg tins) receives bulk-packaged milk powder in the form of the 25 kg bags 1 from a dairy factory for repackaging into the 1 kg tins. The 25 kg bags 1 arrive at the factory and are usually taken to a holding area, where they sit until they are required. When a batch of 1 kg tins are to be made, a worker usually rips off the outer liners 2 from the bags 1 (after checking that the markings 5 on the outer liner 2 are correct for the 1 kg product to be packaged).

If there are a backlog of filled plastic bags (that is, filled inner liners 3 with the outer liners 2 removed) waiting to be cut and tipped into the hopper (or conveying means), the markings 6 on the filled inner liners 3 still enable the relevant information relating to the milk powder to be read by a person or machine. Hence, there is no chance of confusion as to the contents of the filled inner liners 3, and hence there is no chance of the wrong type of powder being inadvertently packaged into the wrong type of 1 kg tin. Moreover, because there will be no confusion as to the contents of each filled inner liner 3, there will be no lost production time as a worker may otherwise have to make enquiries as to the contents of each filled inner liner 3.

In another embodiment, the markings 5,6 may be different, or contain one or more differences, whereby a person would be unable to match the outer liner 2 with the inner liner 3, when viewing the markings 5,6 once the outer liner 2 has been separated from the inner liner 3.

In such an embodiment, and for example, the markings 5,6 may be generated randomly and automatically by a machine (such as a computer or software application) at the time that the markings 5,6 are applied to the inner liner 3 and/or outer liner 2, which further reduces the chance of a worker subsequently being able to match the two markings 5,6, and which therefore adds a further layer of security as to the authenticity of the product, as well protecting against tampering.

For example, the marking 5 on the outer liner 2 may read as "MATAX28395" and the marking 6 on the inner liner 3 may read as "SFJMH126618". Hence, a person viewing either of the markings 5,6 once the outer liner 2 has been separated from the inner liner 3 will be unable to match the filled inner liner 3 with the outer liner 2 that previously covered it.

Preferably however, the different markings 5,6 when fed into a database may be matched up whereby it can be confirmed by the database that the markings 6 on the filled inner liner 3 do in fact match the markings 5 on the outer liner 2. Hence, it may be confirmed (for example, before the milk powder is tipped into a hopper for packaging into 1 kg tins) that the markings 5,6 do in fact match, and hence the milk powder contained within the bag 1 is authentic or genuine and not a counterfeit product and/or has not been tampered with. That is, if a person removed the outer liner 2 and then entered the markings 5,6 into the database, and the database signaled that the markings 5,6 do not match, it may be assumed that the outer liner 2 and/or the inner liner 3 were not actually packaged together, and hence the milk powder contained within the bag 1 may be a counterfeit or substituted or tampered product. Hence, an advantage of such a system is that a worker will be unable to determine this by simply viewing the markings 5,6, and hence the ability of a fraudulent worker, or indeed any person, to otherwise attempt to bring in a counterfeit or substituted product is minimised or negated—because the determination as to authenticity is made by a secure database of the randomly assigned markings 5,6.

FIG. 5 illustrates another possible embodiment of the present invention.

The bag 1 illustrated in FIG. 5 is also a 25 kg bag used for the packaging of milk powder, and also comprises an outer liner 2 (comprised of two or three ply paper material), and an inner liner 3 (comprised of laminated plastic). The inner liner 3 is shown in the cutaway section 4 of the outer liner 2.

The outer liner 2 is provided with a marking 7 and the inner liner 3 is provided with a marking 8.

The marking 7 is a machine readable barcode applied by a laser etching machine (not shown).

The marking 8 is also a machine readable barcode applied by the same laser etching machine.

The barcodes 7,8 may be the same and contain the same information or they may be dissimilar and contain different information. Alternatively, the barcodes 7,8 may contain some identical information and some different information.

For example, the barcodes 7,8 (when read by a machine reader such as a barcode reader) may include, but not be limited to, the date, the factory, the type of powder within the bag, the batch number, the bag number, the "best before" date, a unique identifier for authenticity purposes, the name of the end user, and so on.

The barcodes 7,8 may be applied to the inner and/or outer liners 2,3 in substantially the same fashion as described above in relation to the various embodiments and/or alternatives described in relation to the markings 5,6 of FIG. 4.

The nature of the barcodes 7,8 are stored in a database at the time of application (see FIG. 6).

The nature of the barcodes 7,8 are transferred to the database directly, or indirectly, by the laser etching machine, by the use of wireless communication technologies.

The laser etching machine may be in one-way communication with the database or in two-way communication, whereby data and/or instructions and/or information may travel between the laser etching machine and database in any direction.

Any suitable wireless technology known in the art may be used, including Wi-Fi (IEEE 802.11), LE Bluetooth®, Bluetooth®, other radio frequencies, Infra-Red (IR), GSM, CDMA, GPRS, 3G, 4G, W-CDMA, EDGE or DCDMA200 and similar technologies.

Alternatively, any suitable wired connections or ports may also be used, including, without limitation, USB ports or any other relevant or appropriate technology known in the art.

Preferably, the database may comprise a computing device or other electronic device. Examples include, without limitation, a mobile phone, a smartphone, an iPhone, an iPad, a tablet, a palmtop computer, a band or other wearable technology device, a small portable device, a laptop, a desktop computer, a cloud computing system, a remote network computer system (a public network, e.g. a website, or alternatively a private network) or to a web service.

Alternatively, the laser etching machine may first wirelessly transmit the nature of the barcodes 7,8 to an intermediary computing or electronic device, examples including those mentioned above, prior to the intermediary device subsequently transmitting the data or information to the database. Other examples of an intermediary device may include a router or transmitter or Bluetooth device.

Preferably, the method or system or apparatus may also include the use of a machine reader (not shown), which is capable of accessing, or being in communication with, the database, and which is also capable of reading the barcodes 7,8.

In this way, the machine reader, in conjunction with the database, is able to facilitate a determination as to whether an outer liner 2 subsequently removed from an inner liner 3 is/was the same outer liner 2 associated with the same inner liner 3, at the time when the bag 1 was filled and/or packaged.

In such an embodiment, the machine reader may be adapted, or able, to be in communication with the database, either directly or indirectly, by the use of wireless communication technologies, such as those aforementioned.

The machine reader may be in one-way communication with the database or in two-way communication, in substantially the same fashion as for the laser etching machine described above.

Preferably, the machine reader may be in two-way communication with the database, whereby the database is able to send an alert to the machine reader and/or a third party, if an outer liner 2 removed from an inner liner 3 is/was not the same outer liner 2 associated with the same inner liner 3, at the time when the bag 1 was filled and/or packaged.

The third party may be a separate computing or other electronic device belonging to a factory manager or to a floor manager or foreman or the person overseeing the operation involving the separation of the outer liners 2 from the inner liners 3, and the subsequent emptying of the bags 1, for example into a hopper.

The alert may also, or alternatively, trigger an audio and/or visual alarm in the vicinity of the area where the outer liners 2 are removed from the inner liners 3. Hence, and for example, the operation of removing the outer liners 2 from the inner liners 3 may be halted whilst the anomaly of why a removed outer liner did not match its inner liner—possibly implying that the product may be counterfeit or has otherwise been tampered with.

The system and/or method and/or apparatus may further include the step of sealing the bag 1. The sealing step may occur either after the inner liner 3 has been marked or after the outer liner 2 has been marked.

The bag 1 is sealed in the region of the seal 13 (FIG. 2).

In one embodiment, the laser etching may be formed between the laminates of plastic comprising the inner liner 3. These laminates are not able to be separated without destroying the plastic material comprising the inner liner 3. Hence, the laser etching is not able to be accessed or interfered with or otherwise deformed or altered in any way. Hence, the integrity of the packaging and/or confirmation of the genuine nature of the milk powder and/or supplier is assured.

The outer liner 2 may also be marked via laser etching either prior to the inner liner 3 (or bag 1) being filled, or after the inner liner 3 has been filled. If the latter, the packaging plant may contain a separate laser etching station for marking the outer liner 2 after the bag 1 has been filled.

An advantage of using laser etching technology does away with having to use inkjet printers for marking the outer liner 2 of each bag 1. Hence, the disadvantages and drawbacks associated with the use of inkjet printers generally, as described previously in the specification, are overcome or addressed.

VARIATIONS

While the embodiments described above are currently preferred, it will be appreciated that a wide range of other variations might also be made within the general spirit and scope of the invention, and/or as defined by the appended claims.

We claim:

1. A method of packaging a product, said method comprising:

marking an inner liner of a packaging bag with a first marking device to provide a first marking;

placing the marked inner liner in an initial outer liner of the packaging bag;

filling the inner liner of the bag with the product;

sealing the packaging bag such that the inner liner and the initial outer liner are sealed;

marking the initial outer liner with a second marking device to provide a second marking either before or after sealing the packaging bag;

determining, after a specific outer liner is removed from the inner liner in a location, whether or not a marking on the specific outer liner is associated with the first marking by accessing a computer database associating the first marking and the second marking and a record associating the first marking and the second marking to determine whether or not the specific outer liner is the initial outer liner, the first marking and the second marking containing one or more differences with respect to one another such that the inner liner and the initial outer liner are configured to be unable to be matched by a person; and outputting one or more of an audio alarm and a visual alarm at the location at which the specific outer liner is removed when it is determined that the specific outer liner is not the initial outer liner.

2. The method of packaging as claimed in claim 1, wherein the first marking made on the inner liner by the first marking device is a machine-readable marking.

3. The method of packaging as claimed in claim 1, wherein the second marking made on the initial outer liner by the second marking device is a machine-readable marking.

4. The method of packaging as claimed in claim 1, wherein the first marking made on the inner liner by the first marking device is a machine-readable marking, and the second marking made on the initial outer liner by the second marking device is a machine-readable marking.

5. The method of packaging as claimed in claim 4, wherein the first and second markings made on the inner liner and the initial outer liner, by the first marking device and the second marking device respectively, are stored and associated in the database at the time of application.

6. The method of packaging as claimed in claim 5, wherein an association between the first and second markings made on the inner liner and the initial outer liner are transferred to the database, by the first and second marking devices, either directly or indirectly, by the use of wireless communication technologies.

7. The method of packaging as claimed in claim 5, further comprising determining, by a machine reader, which is configured to access the database, either directly or indirectly, and which is configured to read the first and second markings on the inner liner and/or the outer liner, whether the specific outer liner subsequently removed from the inner liner is the initial outer liner associated with the inner liner, at the time when the bag was filled and/or packaged.

8. The method of packaging as claimed in claim 7, wherein the machine reader is configured to be in communication with the database, either directly or indirectly, by the use of wireless communication technologies.

9. The method of packaging as claimed in claim 8, wherein the machine reader is in two-way communication with the database that is configured to send the one or more of the audio alarm and the visual alarm to the machine reader and/or a third party, when an outer liner removed from an inner liner is not the same outer liner associated with the same inner liner, at the time when the bag was filled and/or packaged.

10. The method of packaging as claimed in claim 1, wherein one or both of the first marking on the inner liner and the second marking on the outer liner includes a barcode.

11. The method of packaging as claimed in claim 1, wherein one or both of the first marking on the inner liner and the second marking on the outer liner includes a QR code.

12. The method of packaging as claimed in claim 1, wherein one or both of the first marking device and the second marking device are laser etching machines.

13. The method of packaging as claimed in claim 1, wherein the first marking device and the second marking device are separate machines.

14. The method of packaging as claimed in claim 1, wherein the first marking device and the second marking device are the same machine.

15. The method of packaging as claimed in claim 1, wherein the inner liner is made of a plastics material.

16. The method of packaging as claimed in claim 1, wherein the initial outer liner is made of a paper material.

17. The method of packaging as claimed in claim 1, wherein the bag is a 25 kg bag configured to package milk powder.

18. The method of packaging as claimed in claim 1, wherein the first marking of the inner liner is formed between laminates of plastic comprising the inner liner.

* * * * *